106-15.05 SR
3/13/79 XR 4,144,367

United States Patent [19]
Landucci

[11] 4,144,367
[45] Mar. 13, 1979

[54] CARPET-TREATING COMPOSITIONS

[75] Inventor: Dennis P. Landucci, Lake Elmo, Minn.

[73] Assignee: Minnesota Mining and Manufacturing Company, Saint Paul, Minn.

[21] Appl. No.: 795,139

[22] Filed: May 9, 1977

[51] Int. Cl.[2] ..... D06M 13/46
[52] U.S. Cl. ..... 428/96; 8/115.6; 106/15.05; 252/8.75; 252/8.8; 260/459 A
[58] Field of Search ..... 252/8.8, 8.75; 8/115.6; 428/96; 106/15 FP; 260/459

[56] References Cited

U.S. PATENT DOCUMENTS

| | | | |
|---|---|---|---|
| T961,008 | 8/1977 | Hendy | 252/8.8 |
| 3,398,182 | 8/1968 | Guenthner et al. | 106/2 |
| 3,468,697 | 9/1969 | Hunter | 260/459 |
| 3,862,045 | 1/1975 | Sato et al. | 252/8.75 |
| 3,896,035 | 7/1975 | Schultz et al. | 252/8.75 X |
| 3,896,251 | 7/1975 | Landucci | 8/115.6 |
| 3,916,053 | 10/1975 | Sherman et al. | 428/96 |
| 3,923,715 | 12/1975 | Dettre et al. | 106/15 FP |

*Primary Examiner*—William E. Schulz
*Attorney, Agent, or Firm*—Cruzan Alexander; Donald M. Sell; Warren R. Bovee

[57] ABSTRACT

Antistatic agents useful in combination with fluorochemical-containing, soil-resistant, carpet-treating compositions for treating carpets having synthetic fiber pile. The antistatic agents comprise certain dialkyl sulfate quaternary salts of N,N-bis(hydroxyethyl) amines. The carpet treatments of this invention provide synthetic fiber pile carpets with an improved balance of performance and aesthetic properties.

11 Claims, No Drawings

CARPET-TREATING COMPOSITIONS

The present invention relates to antistatic agents useful in combination with soil-resistant carpet-treating compositions. More specifically, this invention relates to antistatic agents which comprise certain alkyl sulfate quaternary salts of N,N-bis(hydroxyethyl) amines. The use of these antistatic agents with conventional fluorochemical-containing carpet-treating compositions provides synthetic fiber pile carpets with an improved balance of soiling, static and aesthetic properties.

The use of synthetic fibers in the manufacture of carpeting materials has created a problem in that carpets having synthetic pile-fibers tend to induce the build-up of electrostatic charge on a person walking on the carpet, particularly at low relative humidities. The discharge of the static electricity to ground, such as when the charged person touches a doorknob, light switch, or another person is annoying and can be painful. Synthetic pile carpets also exhibit increased receptivity to soiling and must be treated to improve their soil resistance and cleanability.

Recently carpet manufacturers have employed low denier synthetic organic fibers, such as nylon, to provide carpets having a very soft "hand." Treatment of these carpets with the known soil-resistant, antistatic, carpet-treating compositions may not be satisfactory since the balance between performance characteristics of the carpet, e.g. hand (softness), luster, static propensity and soiling characteristics, may not be maintained. In particular, an improvement in one property, for example static propensity, may be obtained at the expense of another extremely important property such as hand. Recently several soil and stain-resistant treatments for carpets have been developed which are based on specific fluoroaliphatic radical-containing compositions. Exemplary treating compositions and processes are known which decrease the static propensity of carpets. As described hereinafter, they have not proven to be satisfactory due to the accompanying deleterious effects on other performance properties such as hand or luster.

The present invention provides means by which the static propensity of synthetic fiber pile carpets, particularly low denier, e.g. 6 denier, nylon pile carpets is decreased, while substantially maintaining other performance properties such as hand, luster and soil resistance. More specifically, the present invention provides antistatic agents which can be used in combination with conventional fluorochemical containing carpet-treating compositions to provide coatings for synthetic carpet fibers which have significantly reduced static propensity while substantially maintaining other carpet performance properties. The antistatic agent can be applied as a separate treatment in combination with the conventional soil-resistant treatment or coapplied with the conventional treatment, i.e. as an additive to the conventional treating compositions.

The antistatic agents of the present invention comprise salt molecules which are certain dialkyl sulfate quaternary salts of N,N-bis(hydroxyethyl) amines. More preferably, the salt molecules are N,N-bis(hydroxyethyl) alkenyl amines quaternized with dialkyl sulfates wherein the dialkyl sulfates are either dimethyl- or diethyl sulfate or mixtures thereof, and wherein a major percentage, by weight, of the aforementioned salt molecules comprising the antistatic agent have alkenyl groups having at least 18 carbon atoms. Preferably the alkenyl groups may vary in length from about 18 to 22 carbon atoms. The alkenyl groups may be either mono- or polyolefinically unsaturated, provided that the alkenyl groups have an average of at least 1.5 olefinic double bonds per chain.

The preferred antistatic agents of this invention can also be illustrated by reference to the following equation and general structural formulae $$\underset{\text{I}}{R'N(C_2H_4OH)_2} + \underset{\text{II}}{R''_2SO_4} \longrightarrow \underset{\text{III}}{[R'N(C_2H_4OH)_2R'']^+R''SO_4^-}$$

amine — quaternizing agent — antistatic agent wherein R′ represents an alkenyl group having 18–22 carbon atoms in the chain and being free of substituents other than hydrogen and free of aromatic groups and hetero atoms in the chain, and wherein R″ is methyl or ethyl.

These quaternary ammonium salt antistatic agents (III) are obtained by preparing the alkenyl diethanol amine (I) and quaternizing the amine with dimethyl- or diethylsulfate quaternizing agent (II).

The alkenyl diethanolamines (I) are readily available commercially and can be prepared by methods generally described in U.S. Pat. No. 3,371,130 issued Feb. 27, 1968. For example, the amines can be prepared by hydrogenation of the corresponding amide or nitrile followed by reaction of the primary amine product with two moles of ethylene oxide.

The alkenyl diethanolamines can be quaternized by a quaternizing agent such as dimethyl- or diethylsulfate. For example, the alkenyl diethanolamine (I) can be dissolved in a solvent, such as ethyl acetate, the quaternizing agent (II) added and reacted, followed by the addition of water, and the removal of the ethyl acetate via azeotropic distillation to provide the quaternary antistatic agent (III).

The advantageous characteristics of the quaternary amine salts of the present invention are primarily determined by the nature of the alkenyl group of the salt. Accordingly, the characteristics are largely dependent on the particular fatty acid from which the alkenyl group is derived. It has been found that alkenyl groups derived from naturally occurring fatty acids provide particularly desirable properties. Naturally occurring animal and vegetable oils comprise mixtures of fatty acids which vary in chain length, molecular weight distribution and degree of unsaturation, depending on the animal or vegetable source from which they are derived. For example, see Noller, C. R., "Chemistry of Organic Compounds," W. B. Saunders Company, N.Y. (1957), p. 181, for an analysis of various animal and vegetable oils.

Fatty acid mixtures derived from vegetable oils, e.g. cotton, soybean and sunflower oils, are characterized by a major percentage, by weight, of alkenyl groups, e.g. 60–90% or more, having a 17 carbon chain and wherein almost all have 1, and 50% or more have 2, olefinic double bonds, i.e., the alkenyl groups have an average of at least 1.5 olefinic double bonds per chain. Fatty acids from marine derived oils also have a majority of alkenyl groups having 17–21 carbon atoms with a similarly high degree of unsaturation. Alkenyl groups from these sources are characteristically free of substituents other than hydrogen on the chain.

A particularly desirable source of alkenyl groups for use in preparing the amines of the present invention is soybean oil fatty acids which comprise about 21–29% oleic acid and 50–59% linoleic acid. Soybean oil is readily available commercially and has been found to provide antistatic agents with excellent performance characteristics.

As shown in Table I hereinafter, the above-described range of chain length and level of unsaturation appears necessary to obtain the desired balance of carpet performance properties from the antistatic agents described herein. The superior performance of amine salts containing the recited alkenyl groups is particularly surprising in view of the relatively poor performance of antistatic agents derived from closely related tertiary and quaternary amine salts.

The liquid, fluorochemical soil-resistant carpet treating compositions which are used in combination with the antistatic agents of the present invention are well known in the art. These materials comprise mixtures of fluorinated and non-fluorinated components and can be used to provide carpets, particularly those having a synthetic pile fabric, with coatings having excellent soil resistance. A large number of fluoroaliphatic radical-containing components is suitable for use in these carpet-treating compositions, both polymeric and non-polymeric. These components must be non-tacky and non-rubbery solids at room temperature (e.g. 20°–25° C.) and must be both water and oil repellent in order to prevent soiling, especially from particulate soil.

The fluoroaliphatic component contains a fluoroaliphatic radical of at least three carbon atoms and generally has at least one major transition temperature above about 40° C. Transitions are characteristically glass temperature (Tg) or crystalline melting points (Tm), such as are usually detected by DTA (differential thermal analysis) or thermomechanical analysis (TMA). While suitable materials may have, for example, glass transitions at relatively low temperatures such as −25° C. to 0° C., the fluorochemical component generally has at least one major transition temperature above about 40° C., although materials having a major transition temperature below 40° C., such as materials which are waxy or semi-solid, can be useful.

Polymeric fluorinated components can be addition or condensation polymers, including copolymers, obtained by polymerizing, either alone or in conjunction with compatible monomers free of fluoroaliphatic radicals, one or more monomers of the formula $R_fP$ where $R_f$ is a fluorinated aliphatic radical and P is a polymerizable group. Preferably P is an ethylenically unsaturated moiety polymerizable, or copolymerizable, by free radical initiation, electron irradiation, ionic initiation, or the like. $R_fP$ may also be a fluoroaliphatic radical-containing dicarboxylic acid, glycol diamine, hydroxyamine, etc., copolymerizable with a diisocyanate, glycol, diacyl halide, etc. Fluorinated copolymers may be random, alternating, or segmented.

Generally, the fluorinated compounds used in the invention should contain at least 25 percent by weight of fluorine in the form of fluoroaliphatic radicals. A molecular weight of at least about 20,000 daltons generally is preferred for the polymers and copolymers to provide durable non-tacky surface characteristics, although crystalline polymers with molecular weights as low as 3,000 daltons are useful.

Non-polymeric fluoroaliphatic radical containing compounds of substantially lower molecular weight such as the urethane compounds described by Guenther and LaZerte, U.S. Pat. No. 3,398,182 and U.S. Pat. No. 3,484,281; the ester compounds described by Dettre and Greenwood, U.S. Pat. No. 3,923,715; the carbodiimide compounds described by Landucci, U.S. Pat. No. 3,896,251; and the like, are also useful and are particularly preferred for use in this invention.

The fluorinated aliphatic radical $R_f$ is a fluorinated, preferably saturated, monovalent, non-aromatic, aliphatic radical of at least three carbon atoms. The chain may be straight, branched, or if sufficiently large, cyclic, and may be interrupted by divalent oxygen atoms or trivalent nitrogen atoms bonded only to carbon atoms. A fully fluorinated group is preferred, but hydrogen or chlorine atoms may be present as substituents in the fluorinated aliphatic radical provided that not more than one atom of either is present in the radical for every two carbon atoms, and that the radical must at least contain a terminal perfluoromethyl group. "Terminal" as used herein refers to the position in the skeletal chain of the radical furthest removed from the linkage which connects the $R_f$ radical with the body of the molecule. Preferably, the fluorinated aliphatic radical contains not more than 20 carbon atoms because such a large radical results in inefficient use of the fluorine content.

Representative fluorinated components, and reactants for preparing these components, are described in U.S. Pat. No. 3,916,053, issued Oct. 28, 1975, particularly at Column 4, line 5, through Column 5, line 40; U.S. Pat. No. 3,896,035 issued July 22, 1975, particularly at Columns 3 and 4, and U.S. Pat. No. 3,923,715 issued Dec. 2, 1975, particularly at Table I, which disclosures are incorporated herein by reference.

As noted previously, the fluorochemical, soil-resistant, carpet treating compositions comprise a second polymeric component in addition to the fluoroaliphatic component. Such compositions provide a normally solid, soil-resistant coating comprising (a) at least one phase of a water-insoluble addition polymer derived from a polymerizable, ethylenically unsaturated monomer free of non-vinylic fluorine and having at least one major transition temperature above about 40° C. and a solubility parameter of at least about 8.5 and (b) at least one phase of a water-insoluble fluorinated component as described hereinabove wherein at least one of the phases is a continuous phase. The ratio of fluorinated component to addition polymer is preferably in the ratio, based on weight, of from about 1:10 to 10:1, provided that the mixture contains at least 5 percent by weight of fluorine in the form of fluoroaliphatic radicals.

The water-insoluble addition polymers useful in these two-phase carpet treating compositions can be characterized as being normally non-rubbery or curable to a non-rubbery state, non-tacky, normally solid, water-insoluble, and preferably free of ethylenic or acetylenic unsaturation. Water insolubility is required to provide durability to the normal cleaning operations, such as shampooing. In order to be resistant to soil under high compressive load, especially particulate soil, the addition polymer must have at least one major transition temperature above about 40° C., which is a melting point or glass transition at which the polymer becomes significantly softer as the temperature is raised.

The addition polymers may be prepared from suitable monomers such as vinyl fluoride, vinylidene fluoride, vinyl chloride, vinylidene chloride, styrene, alpha-methyl styrene, lower alkyl methacrylates, and glycidyl acrylate and methacrylate. Such monomers can be polymerized or copolymerized with each other or with minor amounts, e.g. 0.5 to 45% of additional monomers to provide or improve particular desired physical or chemical properties, e.g. flexibility, substantivity, surface conductivity, etc. Representative of such additional monomers are vinyl acetate, vinyl pyridine, alkyl acrylates or methacrylates, hydroxy lower alkyl acrylates and methacrylates, acrylamide and methacrylamide, N-methylol acrylamide, itaconic acid and maleic anhydride. The amounts of such additional monomer used must of course not be so great as to impart water solubility to the addition polymer. Also, at least one major transition temperature of the addition polymer must remain above about 40° C. Polymerization may be accomplished in bulk, solution, suspension or emulsion systems by any of the usual polymerization agents, such as gamma radiation, actinic radiation, organic or inorganic peroxides, azobisalkylnitriles, anionic or cationic agents, and the like.

Representative two-phase carpet treating compositions and processes particularly useful in the practice of the present invention are described in U.S. Pat. No. 3,916,053, issued Oct. 28, 1975 (Example IX), and U.S. Pat. No. 3,923,715, issued Dec. 2, 1975 (Example 9). Other two-phase carpet treating compositions comprising fluorinated and fluoroaliphatic radical-free urethane adducts are useful in the present invention and are described in U.S. Pat. No. 3,896,035, issued July 22, 1975. The disclosures of these patents are hereby incorporated by reference.

Carpets and rugs can be treated with the compositions of this invention by any of the customary procedures, such as by padding, spraying, roll-coating and the like. Application by top-spraying a dyed carpet pre-wet to about 40 to 100 percent face pile weight is preferred. The treating composition can be applied from aqueous or non-aqueous solutions or suspensions and the antistatic agent and the fluorochemical, soil-resistant carpet-treating composition can be coapplied or applied sequentially. The most convenient and generally most economical procedure is to prepare a treating solution by blending appropriate quantities of the antistatic agent with the fluorochemical, soil-resistant carpet treating composition. Most preferably, an aqueous solution comprising, for example, about 20% solids by weight of the antistatic agent is blended with an aqueous solution suspension or emulsion, generally a cationic emulsion, comprising about 45% by weight soil-resistant carpet treating solids, diluted with water. Other conventional adjuvants compatible with the above-described components, such as softeners, wetting agents, and the like, may be present.

The ratio of the antistatic agent to the fluorochemical-containing treating composition, based on weight of the solids, can vary from about 1:10 to about 1:1 and is most preferably in the range of about 1:3 to 2:3. The actual concentration of treating solids in the liquid treating solution or emulsion will depend on the amount of liquid to be applied during treatment. This will, in turn, depend on the construction and composition of the carpet as well as the application and drying facilities which are used. Generally a total application of antistatic agent equal to about 0.01 to about 1 percent of the face pile weight of the carpet is required and should be contained in an amount of water corresponding to about 3 to 150, preferably 10 to 30, percent of the face pile dry weight. Thus, aqueous treating solutions containing from about 0.3 to about 15 weight percent treating solids are preferred and most preferably the treating solids should comprise about 0.5 to 3 weight percent of the aqueous treating solution.

When the carpet treatment is to be applied at the dyehouse, the most convenient method is to spray the solutions on to the carpet surface after the dyeing operation and prior to the drying oven. When treatment is to be applied as part of the backing step, the carpet can be sprayed as part of the laminating operation, to be followed by oven drying.

The advantages of treating carpets, particularly low denier nylon fiber face pile carpets, with the treating compositions of the present invention is shown in the example which follows wherein carpets have been treated with the compositions of this invention and the treated carpets evaluated to determine the performance properties of the carpets. More specifically, tests of treated carpets were conducted to determine the static propensity, oil and water stain repellency, soil resistance, hand and luster.

The test for static propensity is conducted by having a subject walk on a carpet under standard conditions using standard test shoes. The build-up of static charge on the subject is then measured on an electrometer. The test is conducted at 21° C. and 20% relative humidity in accordance with AATCC Test Method 134 - 1975, except that testing was done on two consecutive days, the total stepping time for each test was 30 seconds and a rubber pad was used under the carpet. Shoes having both neoprene "Neolite" (a trade name of Goodyear Tire and Rubber Company) and chrome tanned leather soles and heels were used in the tests. It has been found that a generated static charge of about six kilovolts or more will produce discomfort. Generally if the potential is below about 3 kilovolts, no significant effect is observed.

Stain repellency is evaluated in accordance with standard procedures. Oil repellency is tested in accordance with AATCC Test Method 118 - 1966T, Hydrocarbon Resistance Test, in which the higher the number, the greater the resistance to staining by oils. A value of 3 or greater indicates satisfactory performance. Carpets without an effective fluorochemical treatment will generally score zero in this test.

Resistance to water-borne stains is evaluated by placing isolated drops of 70:30 or 80:20 isopropanol:water on the carpet pile surface at 25° C. If the drop fails to penetrate the surface and wet the fiber within 10 seconds, the treatment is considered effective.

Soil resistance is evaluated in accordance with AATCC Test Method 122 - 1967T, a walk-on test. This is a comparative test, each sample consisting of a test piece 30 by 15 cm and a control piece 30 by 15 cm. The combination is placed side by side in a heavily travelled industrial area for an exposure of about 12,000 steps at about 25° C. and 50–70% relative humidity. The samples are rotated periodically to insure uniform exposure and are vacuumed every 24 hours during the test and before visual evaluation.

In this test the control was a carpet which had been treated only with the fluorochemical soil-resistant composition prepared as described in Part A of the following example. Test carpets were then treated with the same soil resistant composition plus antistatic agent.

The control was tested and assigned a soil resistance value of zero. The test carpets were similarly exposed to soiling conditions and assigned a rating on a scale of 0 to −9 in comparison to the control wherein negative numbers represent increasingly greater soiling.

The "hand" and "luster" tests are subjective tactile and visual tests conducted by an experienced evaluator. Hand relates to the softness of the carpet pile surface experienced when the open palm of a human hand is rubbed across the pile face. The carpet under test is assigned a value ranging from 1 to 5. (The values used in obtaining the results reported in Table I are an average of readings by three different evaluators.) The value obtained is compared to the value for a specified control sample which was treated with the same soil resistant composition as the test carpet, but without the antistatic agent. The results were reported in Table I as "better than" (+%) or "worse than" (−%) the control value. These percentages are obtained by subtracting the value for the control from the value for the test carpet and dividing this difference by the control value.

Because the hand of a carpet is sensitive to changes in relative humidity, the carpet is tested initially when removed from the dryer (about 15% R.H.) and also following conditioning at 50% R.H. for 24 hours at room temperature.

Luster is also a subjective test by which a rating is assigned to the carpet on a scale of 1 to 5 (again, the average of readings by three evaluators is used). The rating is compared to the rating obtained by a control carpet and the results reported as "better than" (+%) or "worse than" (31%) the control carpet with percentage values being calculated as for the "hand" test and reported in Table I.

As performed, the hand and luster tests provide a measure of the effect of adding the antistatic agent to the carpet treatment. Ideally the agent should not adversely affect the carpet properties while at the same time improving the static potential property of the carpet.

In order to exemplify the present invention, a soil resistant treating composition and an antistatic agent were prepared.

A: SOIL RESISTANT COMPOSITION

A soil resistant carpet treating composition was prepared comprising a fluoroaliphatic radical-containing component and a fluorine-free acrylate copolymer.

A bis-urethane fluoroaliphatic radical-containing component for carpet treatment was prepared according to Example IX of U.S. Pat. No. 3,916,053, issued Oct. 28, 1975, from 554 parts of N-ethyl perfluorooctanesulfonamidoethanol. A solution of this alcohol in 337 parts of methyl isobutyl ketone was dried of water by distilling to remove 100 parts of solvent and was then cooled to 80° C. To this solution was added 87 parts of tolylene diisocyanate and then very slowly 0.32 parts of dibutyl tin dilaurate as the exothermic reaction permitted. The reverse procedure of adding the catalyst first and the diisocyanate gradually is also satisfactory. After reaction, an emulsion was prepared in a dispersion of 489 parts of water containing a solution of 16 parts of fluoroaliphatic surfactant, $$C_8F_{17}SO_2NHC_3H_6N^+(CH_3)_3Cl^-,$$

in 16 parts acetone and 48 parts water and 16 parts of polyoxyethylene sorbitan monooleate by putting the total dispersion through an homogenizer at 2500 pounds per square inch and 75° C. The emulsion had a solids content of 45%. The solid material had a melting point of 110°–125° C.

An acrylate copolymer was prepared by adding to a glass-lined reactor 3780 parts by weight of water, 108 parts of a polyethoxylated stearyl ammonium chloride cationic surfactant and 4 parts reactive cationic monomer having the formula $$CH_2=C(CH_3)$$
$$CO_2CH_2CH(OH)CH_2N^+(CH_3)_3Cl^-.$$

The solution was freed of oxygen by alternately evacuating and repressuring with nitrogen. 720 parts of methylmethacrylate and 720 parts of ethylmethacrylate were then added, the mixture heated to 60° C., and 14 parts of a free radical polymerization initiator (2,2'diguanyl -2,2'azapropane hydrochloride), dissolved in water, was added. When the reaction was initiated and the temperature began to rise, the temperature was maintained at 85° C. while a mixture of 2880 parts methylmethacrylate, 2380 parts ethylmethacrylate, and 4200 parts of water was slowly added. Agitation at 85° C. was continued until completion, about six hours. The acrylate copolymer emulsion contained about 45% copolymer solids.

A stain and soil-resistant carpet treating composition was prepared by blending 1 part of the fluoroaliphatic radical-containing bis-urethane emulsion with 2 parts of the acrylate copolymer emulsion.

B: ANTISTATIC AGENT

An antistatic agent was prepared by dissolving 350 parts N,N-bis(hydroxyethyl) soya amine ("Ethomeen" S/12, Armour Chemical Co.) in ethyl acetate. The solution was heated to 60° C. and 144.8 parts of diethyl sulfate was added. The mixture was heated at 60° C. for one hour, followed by the addition of water and the removal of the ethyl acetate by azeotropic distillation. A 20% solids aqueous solution was obtained.

Carpet samples were treated with the soil-resistant composition described in A above to provide control samples. An antistatic carpet-treating composition comprising 45 parts by weight of composition A and 33 parts of antistatic agent B was prepared by mixing with 922 parts water. Carpet samples prewet to 75% wet pickup were treated with this antistatic composition at the rate of 0.32% total solids on dry face pile weight, then tested and compared with the control. The results are shown in Table I hereinafter.

To further demonstrate the uniqueness of the antistatic agents of the present invention, Table I shows antistatic agents comprising quaternary and tertiary amine salts of similar amine compounds compared with those of the present invention.

In Table I, the antistatic agent of the present invention prepared in "B" above (N-ethyl N,N-bis(hydroxyethyl) soya ammonium ethylsulfate) will be identified as antistatic agent "1". The antistatic agents compared with agent 1 of the present invention will be identified in Table I according to the following schedule:

2. N,N-bis(hydroxyethyl) soya ammonium hydrogen sulfate
3. N,N-bis(hydroxyethyl) soya ammonium acetate 4. N,N-bis(hydroxyethyl) soya amine (free base)
5. N-ethyl-N-8-hydroxy-3,6 dioxooctyl-N-5 hydroxy-3-oxopentyl soya ammonium ethyl sulfate
6. N-ethyl-N,N-bis(hydroxyethyl) oley ammonium ethyl sulfate
7. N-methyl-N,N-bis(hydroxyethyl) coco ammonium chloride
8. N-methyl-N,N-bis(hydroxyethyl) stearyl ammonium chloride
9. Methyl tris(hydroxyethyl) ammonium sulfate
10. Hydroxyethyl trimethyl ammonium sulfate The "Soil-Resistant Composition" referred to in Table I is the composition "A" described hereinabove, unless noted otherwise.

Table I

| Antistatic Agent | Soil-Resistant Composition | Hand[a] Initial 15% R.H. | Hand[a] Conditioned 50% R.H. | Luster[a] | Static Potential[a] Leather/Neolite | Soiling[b] |
|---|---|---|---|---|---|---|
| 1 | A | +35% | +19% | −17% | 3.3 KV / 1.8 KV | 0 |
| 1 | fluoro citrate/poly-methyl methacrylate* | −11 | +27 | +25 | 1.0 / 1.0 | 0 |
| 2 | A | −11 | − 6 | −37 | 3.9 / 2.4 | 0 |
| 3 | A | −27 | − 9 | 0 | 2.5 / 2.3 | −1 |
| 4 | A | −21 | − 9 | +15 | 3.9 / 2.0 | −1.5 |
| 5 | A | −35 | −26 | −43 | 1.4 / 1.4 | −1.5 |
| 6 | A | −50 | −15 | −43 | 2.9 1 3.3 | 0 |
| 7 | A | 0 | −15 | 0 | 2.4 / 2.0 | −1.5 |
| 8 | A | −17 | −19 | −26 | 2.5 / 2.8 | −3 |
| 9 | A | −57 | −48 | −50 | 1.9 / 1.4 | −1.5 |
| 10 | A | −48 | −45 | −50 | 0.5 / 0.5 | 0 |

The oil and water stain resistance of all samples was equivalent to control treated with soil-resistant composition.
[a]Carpet is 50 oz/yd$^2$ - Cabin Craft, nylon splush "Silken Charm."
[b]Carpet is 50 oz/yd$^2$ - Cabin Craft, nylon splush "Great expectations." Untreated Static Potential 7.7 KV / 6.3 KV
*As described in Example 9 of U.S. Patent 3,923,715

What is claimed is:

1. An antistatic agent for synthetic carpet fibers comprising alkyl sulfate quaternary salts of N,N-bis(hydroxyethyl) alkenyl amines having the formula $$[R'N(C_2H_4OH)_2\,R'']^+R''SO_4^-$$

wherein the alkyl group R'' is methyl or ethyl and wherein a major percentage, by weight, of the salt molecules have alkenyl groups R' having at least 18 carbon atoms in the chain, said alkenyl groups having an average of at least 1.5 olefinic double bonds per chain.

2. An antistatic agent according to claim 1 wherein said alkenyl groups are derived from a vegetable oil fatty acid mixture.

3. An antistatic agent according to claim 2 wherein said vegetable oil is soybean oil.

4. A soil-resistant, carpet-treating composition comprising a liquid phase containing carpet-treating solids comprising a fluoroaliphatic radical-containing component wherein the improvement comprises an antistatic agent, in combination with said carpet-treating solids, comprising a quaternary salt according to claim 1, said antistatic agent being present in an amount effective to provide a reduced static propensity to synthetic organic carpet fibers.

5. A treating composition according to claim 4 wherein said fluoroaliphatic radical-containing component is a water-insoluble fluorinated component containing a fluoroaliphatic radical of at least 3 carbon atoms, said fluorinated component containing at least 25% by weight of fluorine therein in the form of fluoroaliphatic radicals, said carpet treating solids additionally containing at least one water-insoluble addition polymer derived from polymerizable ethylenically unsaturated monomers free of non-vinylic fluorine, said polymer having at least one major transition temperature higher than about 40° C. and a solubility parameter of at least about 8.5, the weight ratios of said fluorinated component to said addition polymer being in the range of from 1:10 to 10:1.

6. A soil-resistant, carpet-treating composition comprising a liquid phase containing carpet-treating solids comprising a fluoroaliphatic radical-containing component wherein the improvement comprises an antistatic agent, in combination with said carpet-treating solids, comprising a quaternary salt according to claim 3, said antistatic agent being present in an amount effective to provide a reduced static propensity to synthetic organic carpet fibers.

7. A treating composition according to claim 6 wherein said fluoroaliphatic radical-containing component is a water-insoluble fluorinated component containing a fluoroaliphatic radical of at least 3 carbon atoms, said fluorinated component containing at least 25% by weight of fluorine therein in the form of fluoroaliphatic radicals, said carpet treating solids additionally containing at least one water-insoluble addition polymer derived from polymerizable ethylenically unsaturated monomers free of non-vinylic fluorine, said polymer having at least one major transition temperature higher than about 40° C. and a solubility parameter of at least about 8.5, the weight ratios of said fluorinated component to said addition polymer being in the range of from 1:10 to 10:1.

8. A synthetic pile fiber carpet having a normally solid, durably soil-resistant coating thereon comprising a fluoroaliphatic radical-containing component wherein the improvement comprises an antistatic agent in combination with said soil-resistant coating, said antistatic agent comprising a quaternary salt according to claim 1, said antistatic agent being present in an amount effective to provide a reduced static propensity to said synthetic carpet fibers.

9. A synthetic pile fiber carpet according to claim 8 wherein said fluoroaliphatic radical-containing component is a water-insoluble fluorinated component containing a fluoroaliphatic radical of at least 3 carbon atoms, said fluorinated component containing at least 25% by weight of fluorine therein in the form of fluoroaliphatic radicals, said carpet coating additionally containing at least one water-insoluble addition polymer derived from polymerizable ethylenically unsaturated monomers free of non-vinylic fluorine, said polymer having at least one major transition temperature higher than about 40° C. and a solubility parameter of at least about 8.5, the weight ratios of said fluorinated component to said addition polymer being in the range of from 1:10 to 10:1.

10. A method of treating synthetic pile fiber carpets to provide a normally solid coating on the fibers thereof to render said carpet durably soil-resistant and antistatic, said method comprising (a) treating said carpet with an aqueous solution of an antistatic agent according to claim 1, (b) treating said carpet with an aqueous carpet treating composition containing carpet treating solids comprising a fluoroaliphatic radical-containing component, and (c) drying said carpet to remove said aqueous liquid.

11. A method according to claim 10 wherein treatments (a) and (b) are performed simultaneously.

* * * * *